US005472140A

United States Patent [19]

Versaw et al.

[11] Patent Number: 5,472,140

[45] Date of Patent: Dec. 5, 1995

[54] BUBBLER

[75] Inventors: Douglas P. Versaw; Max L. Green, both of Mansfield, Ohio

[73] Assignee: Therm-O-Disc, Incorporated, Mansfield, Ohio

[21] Appl. No.: 273,374

[22] Filed: Jul. 8, 1994

[51] Int. Cl.[6] ..... E03B 9/20

[52] U.S. Cl. ..... 239/24; 239/29

[58] Field of Search ..... 239/24, 25, 26, 239/27, 28, 29, 29.3, 29.5, 31, 32, 30; 251/366; 137/801, 454.6

[56] References Cited

U.S. PATENT DOCUMENTS

| | | | |
|---|---|---|---|
| 2,172,306 | 9/1939 | Zinkil et al. | 239/24 |
| 2,177,444 | 10/1939 | Steen | 239/31 |
| 2,949,238 | 8/1960 | Taylor | 239/31 |
| 3,329,345 | 7/1967 | Scott | 239/24 |
| 3,554,446 | 1/1971 | Castillo | 239/24 |
| 3,567,121 | 3/1971 | Dreibelbis et al. | 239/29.5 |
| 3,902,600 | 9/1975 | Turner et al. | 137/454.6 |
| 3,921,903 | 11/1975 | Grimes et al. | 239/29 |
| 4,009,806 | 3/1977 | Dreibelbis et al. | 239/29.5 |
| 5,060,857 | 10/1991 | Engelbach | 239/32 |

*Primary Examiner*—Andres Kashnikow
*Assistant Examiner*—Christopher G. Trainor
*Attorney, Agent, or Firm*—Jones, Day, Reavis & Pogue

[57] ABSTRACT

A one-piece casting for a water fountain bubbler having a cavity for a flow regulator cartridge, an inlet port, and inlet and outlet passages all integrally cast therein.

7 Claims, 2 Drawing Sheets

BUBBLER

BACKGROUND O THE INVENTION

This application relates to the art of fluid dispensing and, more particularly, to bubblers for dispensing water from water fountains. The invention is particularly applicable to classroom bubblers and will be described with specific reference thereto. However, it will be appreciated that the invention has broader aspects and can be used in other types of bubblers.

Classroom bubblers typically have an elongated copper tube connected to a water discharge nozzle and to a nipple on a flow regulator by swaged fittings. Assembly of the tube and fittings is difficult and the fittings occasionally develop leaks. It would be desirable to have a classroom bubbler that eliminates the copper tube and fittings.

SUMMARY OF THE INVENTION

A one-piece casting for a water fountain classroom bubbler has a flow regulator cartridge cavity, an inlet port, and inlet and outlet passages all integrally cast therein.

In a preferred arrangement, the cavity for the flow regulator cartridge is substantially opposite the inlet port which communicates through a short inlet passage with the flow regulator cartridge cavity. An outlet passage from the flow regulator cartridge cavity intersects an elongated transversely extending connecting passage that in turn intersects an upwardly inclined discharge passage. The intersections of the connecting passage with the outlet and discharge passages are smoothly curved.

The cast bubbler has a mounting portion with the flow regulator cartridge cavity and the inlet port therein. The casting has an extension portion extending laterally from the mounting portion intermediate the top and bottom ends of the mounting portion. The casting further has an upwardly inclined portion that is inclined upwardly from the extension portion. The connecting passage is in the extension portion of the casting and the discharge passage is in the upwardly inclined portion of the casting.

In a preferred arrangement, the connecting passage extends substantially horizontally while the outlet passage from the flow regulator cartridge cavity extends substantially vertically and the discharge passage is inclined upwardly from the horizontal at an angle between about 55°–75°. The connecting passage and the discharge passage are located substantially closer to the lower surface of the casting than to the upper surface thereof.

The length of the connecting passage is substantially greater than the length of either of the outlet and discharge passages. The discharge passage also has a length that is substantially greater than the length of the outlet passage.

The connecting passage is located within the casting such that it cannot be formed by drilling without penetrating the casting at a location other than through the outlet and discharge passages.

It is a principal object of the present invention to provide an improved classroom bubbler.

It is also an object of the invention to provide a one-piece classroom bubbler casting having all of the necessary cavities and passages integrally cast therein.

It is a further object of the invention to provide an improved classroom bubbler that is easier to assemble and reduces the possibility of leaks.

DESCRIPTION OF A PREFERRED EMBODIMENT

Figure 1:
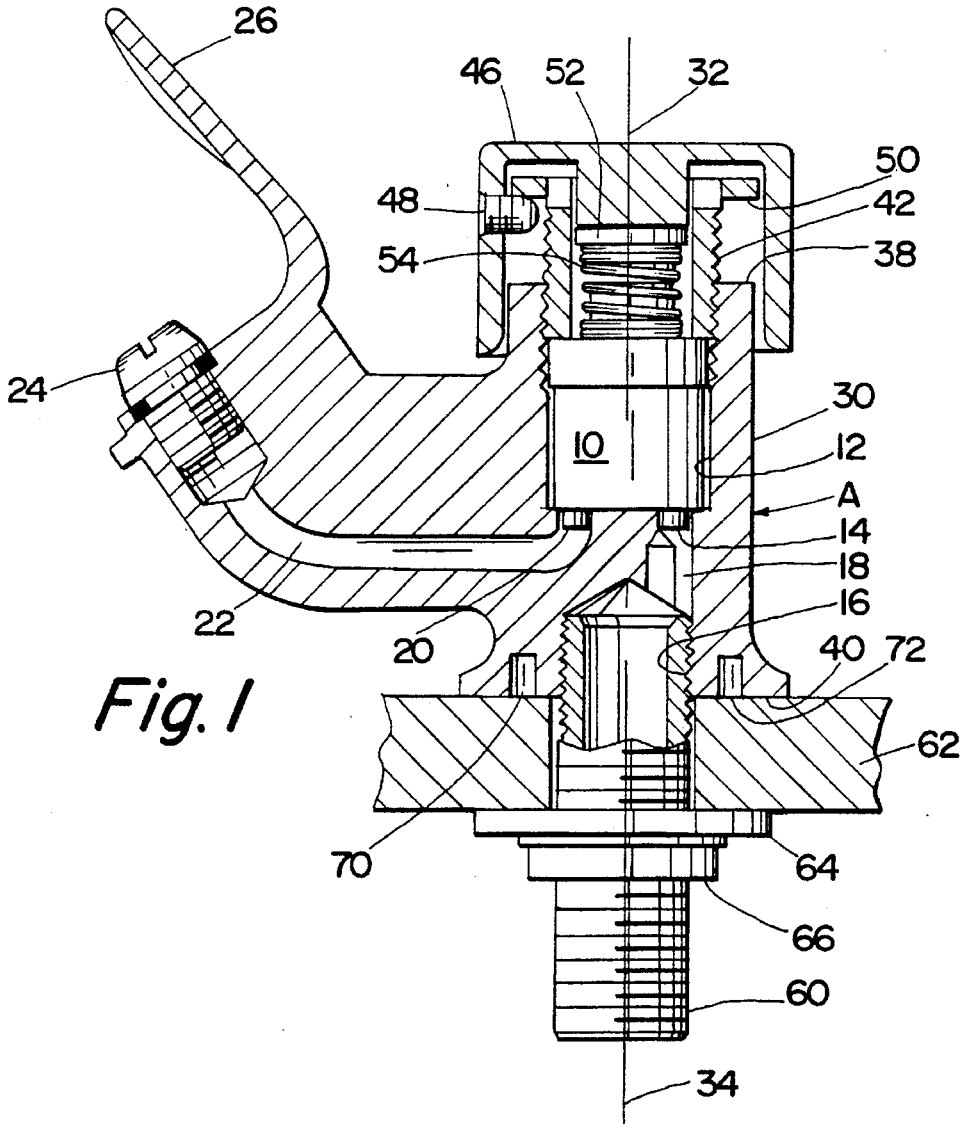
FIG. 1 is a side cross-sectional elevational view of a bubbler constructed in accordance with the present application.

Referring now to the drawing, wherein the showings are for purposes of illustrating a preferred embodiment of the invention only and not for purposes of limiting same, FIG. 1 shows a classroom bubbler that includes a one-piece casting A. Many different materials and alloys may be used to form casting A and one example of a preferred material is an alloy of stainless steel.

A water flow regulator cartridge 10 received in a cavity 12 has an inlet nipple 14 communicating with an inlet port 16 through an inlet passage 18. Flow regulator cartridge 10 has an outlet nipple 20 communicating with an outlet passage 22 leading to a discharge nozzle 24. A shield 26 integral with casting A extends upwardly over nozzle 24. Cartridge 10 may be of any suitable type such as that disclosed in U.S. Pat. No. 3,902,600 issued Sept. 2, 1975.

Casting A includes an enlarged mounting portion 30 having cavity 12 and inlet port 16 located substantially opposite one another along substantially coincidental longitudinal axes 32, 34. Mounting portion 30 has substantially parallel top and bottom ends 38, 40. Cavity 12 is internally threaded adjacent top end 38 for threadably receiving an externally threaded retainer 42 that holds flow regulator cartridge 10 within cavity 12.

A push button 46 positioned over retainer 42 and top end 38 of mounting portion 30 has a transverse set screw 48 located beneath an outwardly extending flange 50 on retainer 42 for preventing removal of push button 46. Depressing push button 46 operates an actuator 52 on flow regulator cartridge 10 for dispensing water therethrough. Releasing push button 46 returns flow regulator cartridge 10 to a closed position by action of a coil spring 54.

Inlet port 16 is internally threaded for threadably receiving an externally threaded supply fitting 60 that extends through a suitable hole in a water fountain basin 62. Washer 64 and nut 66 cooperate with supply fitting 60 and water fountain base 62 for securely mounting bubbler A as shown. Recesses 70, 72 in bottom end 40 of mounting portion A receive pins extending upwardly from water fountain basin 62 to prevent rotation of casting A relative to the basin. The opposite end of supply fitting 60 is connected with a water supply.

Figure 2:
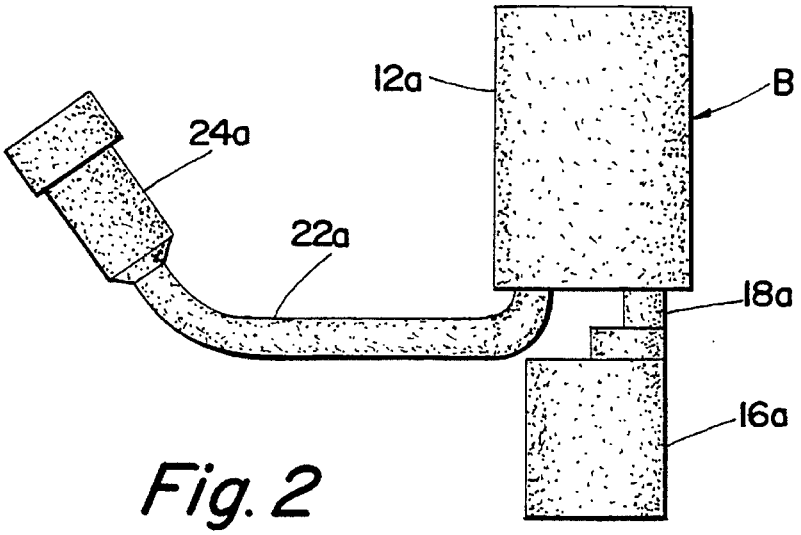
FIG. 2 is a side elevational view of a core used to make the cast bubbler of FIG. 1.

FIG. 2 shows a one-piece core of sand or ceramic used to make the casting for the bubbler. A pattern is made in separable mold parts to the external shape of core B. The mold is then filled with sand or ceramic and cured. Separation of the mold parts then provides core B as shown. Core B includes a cylindrical cavity forming portion 12*a*, and opposite inlet port forming portion 16*a*, an inlet port forming portion 18*a*, an outlet passage forming portion 22*a* and a discharge nozzle cavity forming portion 24*a*.

Figure 3:
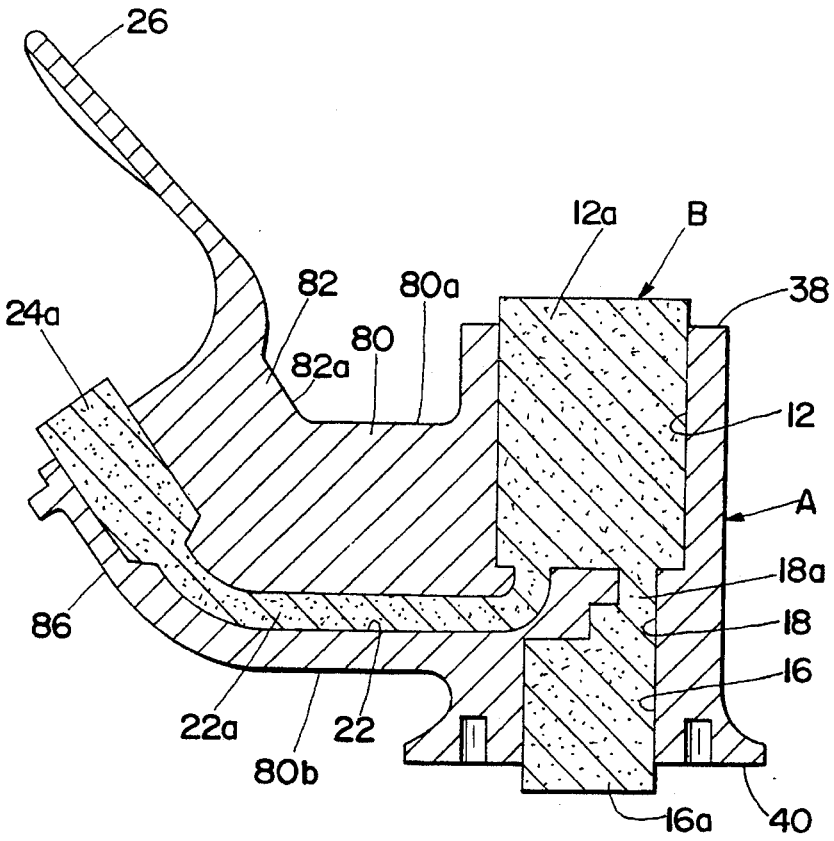
FIG. 3 is a side cross-sectional elevational view showing a bubbler body cast around the core of FIG. 2.
Figure 4:
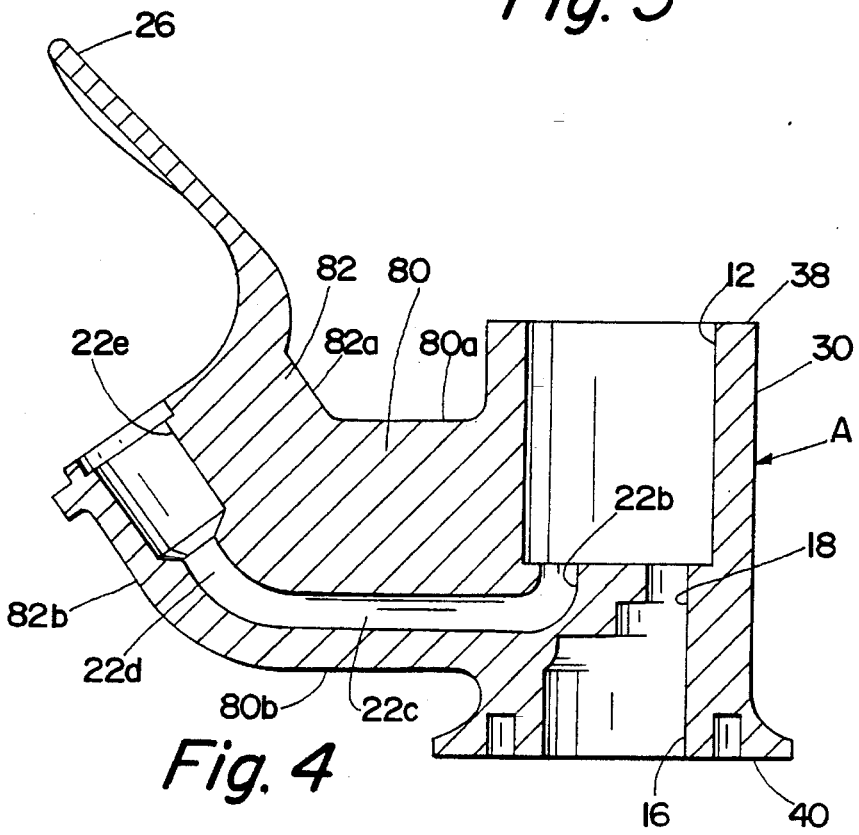
FIG. 4 is a side cross-sectional elevational view showing the one-piece classroom bubbler casting after the core has been removed therefrom.

A pattern is also made to the external shape of casting A in separable mold parts. The mold parts have recesses for receiving the extended end portions of portions 12*a*, 16*a* and 24*a* to hold core B within the casting mold parts. With the core so positioned within the mold for the bubbler casting, the mold is filled with wax that surrounds core B and fills the mold to the shape of bubbler A as shown in FIG. 3. The wax pattern is allowed to solidify, and is then removed from the mold and dipped in a ceramic slurry that solidifies around the wax pattern to form a ceramic mold in which an inlet/outlet sprue is provided. The wax is then melted and drained from the ceramic mold to leave core B supported therein. The ceramic mold is then fired. The internal cavity previously occupied by the wax is then filled with metal to form casting A. The ceramic mold and core B are then separated from the casting by breakage to provide a casting A as shown in FIG. 4. Cavities 12*a*, 16*a* and 24*a* are then machined and tapped for receiving the components described with respect to FIG. 1.

As shown in FIG. 4, outlet passage 22 includes a substantially vertical outlet passage 22*b* intersecting a substantially horizontal connecting passage 22*c* which in turn intersects an upwardly inclined discharge passage 22*d*. Discharge passage 22*d* is inclined upwardly from the horizontal at an angle between about 55°–75° and most preferably about 60°.

The intersections of outlet passage 22*b* and discharge passage 22*d* with connecting passage 22*c* are smoothly curved. The surface of outlet passage 22 is a rough as-cast surface in contrast to a drilled or machined passage. Casting A is continuous and substantially homogenous along the entire length of outlet passage 22. Connecting passage portion 22*c* is located within casting A where it cannot be drilled without penetrating through the casting to create an opening that would have to be plugged and thereby creating a discontinuity and a non-homogenous portion around the outlet passage.

Casting A has an elongated horizontal extension portion 80 that extends laterally from mounting portion 30 intermediate top and bottom ends 38, 40 thereof. Extension portion 80 intersects an upwardly inclined casting portion 82 having discharge passage 22*d* and nozzle cavity 22*e* therein.

Extension portion 80 and upwardly inclined portion 82 have upper surfaces generally indicated at 80*a*, 82*a* and lower surfaces indicated at 80*b*, 82*b*. Outlet passage 22 is located substantially closer to lower surfaces 80*b*, 82*b* than to upper surfaces 80*b*, 82*b*. Outlet passage 22 is located substantially below the center line or longitudinal axes of extension portion 80 and upwardly inclined portion 82.

The length of connecting passage 22*c* is substantially greater than the length of either outlet passage 22*b* or discharge passage 22*d*. The length of discharge passage 22*d* is also substantially greater than the length of outlet passage 22*b*. Each of outlet passage 22*b* and discharge passage 22*d* intersect connecting passage 22*c* at included angles of at least 90°.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A water fountain bubbler comprising a one-piece casting having a mounting portion with top and bottom ends, an extension portion that extends laterally from said mounting portion intermediate said top and bottom ends thereof and terminates in an upwardly inclined portion that is upwardly inclined from said extension portion, said mounting portion having a cavity for receiving a water flow regulator cartridge and said cavity having a cavity bottom, an inlet port generally opposite said cavity and communicating therewith through an inlet passage extending between said inlet port and said cavity bottom, an outlet passage in said cavity bottom, a transversely extending connecting passage in said extension portion intersecting said outlet passage, and a discharge passage in said upwardly inclined portion intersecting said connecting passage.

2. The bubbler of claim 1 wherein said extension portion and said upwardly inclined portion have upper and lower surfaces, said connecting passage and said discharge passage being located substantially closer to said lower surfaces than to said upper surfaces.

3. The bubbler of claim 1 wherein said connecting passage extends substantially horizontally and said outlet passage extends substantially vertically and said discharge passage is inclined upwardly from the horizontal at an angle between about 55°–75°.

4. The bubbler of claim 1 wherein said connecting passage has a length substantially greater than the length of either of said outlet and discharge passages.

5. The bubbler of claim 4 wherein said discharge passage has a length substantially greater than the length of said outlet passage.

6. The bubbler of claim 1 wherein said connecting passage intersects said outlet and discharge passages at smoothly curved intersections.

7. The bubbler of claim 1 wherein said cavity and said inlet port have substantially coincidental longitudinal axes.

* * * * *